United States Patent [19]

Boucher

[11] Patent Number: 4,781,350

[45] Date of Patent: Nov. 1, 1988

[54] ADJUSTABLE MARINE INSTRUMENT MOUNTING MECHANISM

[75] Inventor: Stephen G. Boucher, Amherst, N.H.

[73] Assignee: Airmar Technology Corporation, Amherst, N.H.

[21] Appl. No.: 81,875

[22] Filed: Aug. 5, 1987

[51] Int. Cl.[4] ..... E04G 3/00

[52] U.S. Cl. ..... 248/286; 248/642

[58] Field of Search ..... 248/286, 287, 278, 279, 248/324, 642, 640, 641, 293, 291, DIG. 4; 73/866 S; 440/19, 20

[56] References Cited

U.S. PATENT DOCUMENTS

| | | | |
|---|---|---|---|
| 2,715,884 | 8/1955 | Greenlee | 440/19 |
| 3,980,039 | 9/1976 | Henning | 248/642 X |
| 4,227,480 | 10/1980 | Carras | 248/642 X |
| 4,285,485 | 8/1981 | Burke | 248/291 |
| 4,667,915 | 5/1987 | Boucher et al. | 248/293 |
| 4,687,448 | 8/1987 | Peirce | 248/642 X |

*Primary Examiner*—Ramon O. Ramirez

*Attorney, Agent, or Firm*—Hamilton, Brook, Smith & Reynolds

[57] ABSTRACT

An adjustable marine instrument mounting mechanism having a tube (2) for mounting a sensor (S) at one end, a base (14) which is attachable to a boat, and a housing (28) which pivots on the base and which mounts the tube and the instrument. Means (104) employed to latch the housing to the base in an operative non-pivoting position, and means (50), (52) and (72) are employed for latching the tube and instrument in both an elevated inoperative position and a lowered operative position.

11 Claims, 7 Drawing Sheets

ADJUSTABLE MARINE INSTRUMENT MOUNTING MECHANISM

FIELD OF THE INVENTION

The invention relates in general, to a mechanism for mounting electronic instruments, such as transducers and sensors and in this instance, a searchlight type sonar on the hull of the boat. More particularly, the invention is directed to a mounting mechanism which permits the instrument readily to be removed from the boat when not in use, to be elevated and lowered between inoperative to operative positions, and which also permits the instrument to automatically move to an inoperative position, if, for example, it should strike a submerged object or if the boat speed exceeded a certain predetermined amount. The mechanism also permits the instrument to move from an inoperative position to an operative, latched position when the boat's direction is reversed.

BACKGROUND OF THE INVENTION

There are many types of marine instruments available for commercial and pleasure craft today. Some of them include devices for measuring water locating fish. The present invention has particular application for the mounting of fish finding sonar devices, and particularly of the type called a searchlight sonar. A sonar is an echo sounder which includes a transducer to emit a sound-beam downwardly from the boat. When the beam strikes something, such as the bottom or a fish, it will reflect an echo back to the transducer. This is converted to electrical energy, amplified and displayed as information on a screen. It may also display information on a paper graph, flashing devices and even on video displays.

While echo sounders initially were employed to give information about depth, more sophisticated types of devices provide information about the location of fish, both individuals and schools, as well as, to the type of bottom that is located below and around the boat.

A searchlight type of sonar employs a narrow sound-beam that can be pointed in a variety of directions. Generally speaking, the beam is directed in a forward and downward direction. For example, it may be projected downwardly from the boat at 45° while simultaneously the beam is oscillated back and forth over an arc which typically might be 90° or can even approach 180°. It is to this type of mechanism that the present invention has particular applicability.

SUMMARY OF THE INVENTION

The invention is embodied in an adjustable marine instrument mounting mechanism which includes a tube which has means at one end for mounting an instrument which is herein illustrated as a searchlight sonar, although it may mount any marine instrument if desired. The tube is slidable through guide blocks which fit closely around the exterior of the tube. The tube has a cross-sectional, teardrop-like shape to minimize its resistance to the flow of water and prevent rotation in the guide blocks. Accordingly, the guide blocks are shaped in similar fashion to accommodate the tube. The guide blocks are mounted within a housing and are spaced from each other to afford longitudinal stability to the mounting tube.

A base, which is attachable to the boat, has means for pivotally mounting the guide block housing and includes means for releasably latching the housing to the base in an operative, non-pivoting position. The housing latching means are releasable by a predetermined force against either the tube or the instrument which it mounts to permit the instrument to pivot away from the boat to prevent damage to the instrument in the event it strikes a foreign object or if the boat exceeds a predetermined speed.

Since most fish sensing is done at very low speeds, it is desirable to position the instrument in the inoperative position only at this time because at high speeds, the instrument could be subject to excessive damage. Accordingly, the mechanism provides releasable latching means to latch the tube, which mounts the instrument, in an upper, inoperative position with the instrument above the bottom of the boat, and again in a lower operative position with the instrument below the bottom of the boat.

Manual means are provided for releasing the latching means to permit the instrument to be pulled upwardly by a lanyard, for example. The instrument locks automatically in both positions by pins on the support tube which engage either of an upper or a lower hook means on a single latch mechanism which is pivoted in the housing.

If the instrument has been disengaged from its operative position either by striking a submerged object or because the boat has exceeded a predetermined speed, it can be automatically reengaged by reversing the boat. In this case, a force loaded latching bar is engaged by a cam on the mounting base which has a surface which produces resistance to the pivotal motion of the housing toward the transom of the boat. This permits, however, the instrument to be reengaged and locked in position without any excessive jaring or unwanted force.

The above and other features of the invention including various novel details of construction and combinations of parts, will now be more particularly described with reference to the accompanying drawings and pointed out in the claims. It will be understood that the particular adjustable marine instrument mounting mechanism embodying the invention is shown by way of illustration only and not and features of this invention may be employed in varied and numerous embodiments without departing from the scope of the invention.

DETAILED DESCRIPTION OF THE INVENTION

Figure 1:
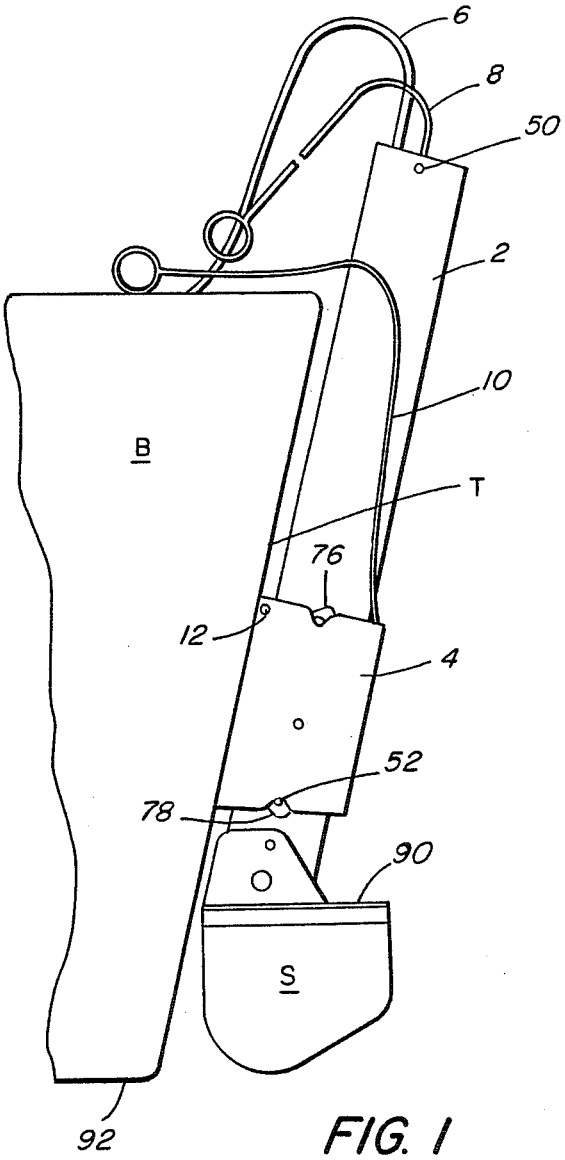
FIG. 1 is a side elevation of a marine instrument mounting mechanism secured to the transom of a boat with the instrument in elevated, inoperative position.

Referring to FIG. 1, a portion of the stern of a boat B including its transom T will be seen. The direction of the boat's movement in a forward direction is from right to left as viewed in the figures.

An illustrative marine instrument such as a sensor, and herein shown as a searchlight sonar, is adjustably secured to the lower end of a tube 2, which is movable vertically in an adjustable mounting mechanism 4. The sensor is connected by an electric cable 6 to control and display equipment within the boat and which is not shown. A lanyard 8 is connected to the tube 2 to permit it to be pulled upwardly relative to the mounting mechanism 4 and a second lanyard 10 is connected to latching mechanism within the mounting mechanism hereinafter to be described.

As will be seen in FIG. 2, the mounting tube 2 and accordingly the sensor S, are in their lower or operative position with the sensor S below the bottom 92 of the boat. At this time the tube is locked to the mounting mechanism 4 to prevent unwanted upward pivoting movement of the sensor.

As shown in the dotted line position, the sensor S and the tube 2 have pivoted in a counter-clockwise direction upwardly from their operative position, either because the boat had exceeded a predetermined speed and the force of the water caused the unlocking of the mounting mechanism or the sensor or tube might have hit a submerged object. It will be seen that the pivoting takes place about a point 12 close to the transom T of the boat.

Figure 4:
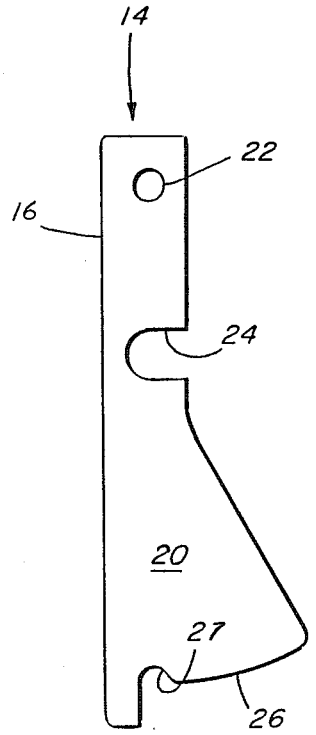
FIG. 4 is a right side elevation of the mounting base shown in FIG. 3.
Figure 3:
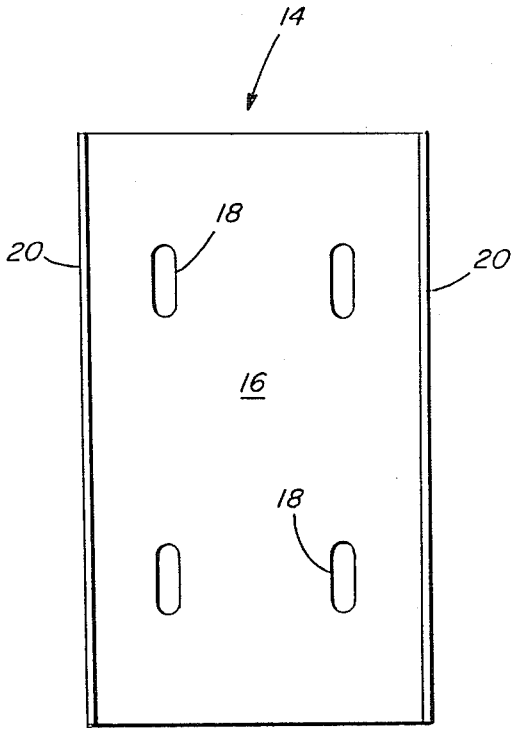
FIG. 3 is a rear elevation of the mounting base of the mounting mechanism.

FIGS. 3 and 4, illustrate a mounting base generally indicated 14. Included is a flat-back plate 16 having four elongate holes 18 through which screws may pass to adjustably secure the mounting base to the transom T of the boat. Joined to the plate 16 are a pair of rearwardly extending flanges 20, each of which includes a bore 22 for receiving a pin, hereinafter to be shown and described, to permit a housing 28, hereinafter to be described to pivot relative to the mounting base. An arcuate groove 24 is formed in each flange 20. A cam surface 26 is formed near the bottom of each flanges which leads to a locking notch 27. Together they form part of a latching mechanism to permit the housing to releasably engage the base 14.

Figure 6:
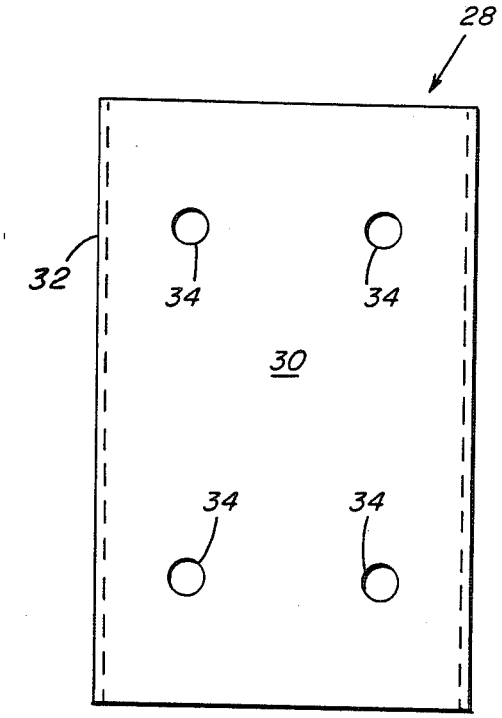
FIG. 6 is a rear elevation of the housing.
Figure 5:
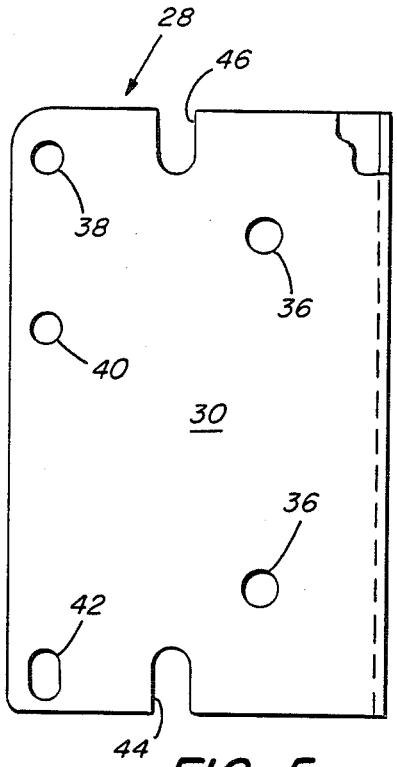
FIG. 5 is a right side elevation of the housing of the mounting mechanism.
Figure 7:
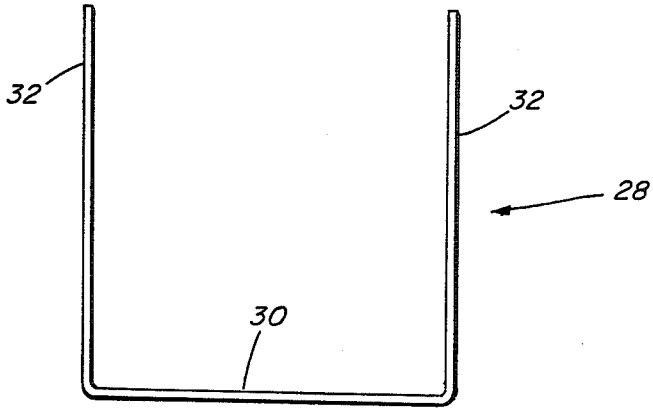
FIG. 7 is a top view of the housing.

The housing 28 is shown in FIGS. 5 to 7 and is substantially U-shaped in cross-section as seen in FIG. 7. It includes a back 30 and two parallel sides 32. The back includes four holes 34 to accommodate screws for mounting guide blocks which will be described in detail hereinafter. Each of the sides 30 include a pair of holes 36 which also receive screws for mounting the guide blocks. A hole 38 is formed near the top of the sides and it meshes with hole 22 in the mounting base 16 to receive a pivot pin to permit the housing 28 to pivot relative to the mounting base 14. Also included in each side 30 is a hole 40 and adjacent the bottom of each side is an elongated slot 42 which will be described in more detail hereinafter.

Aligned, elongated slots 44 and 46 are formed in the bottom and the top of the sides 32 to accommodate pins 50 and 52 (FIGS. 1 and 2) in the mounting tube and which will functionally be described in greater detail hereinafter.

Figure 8:
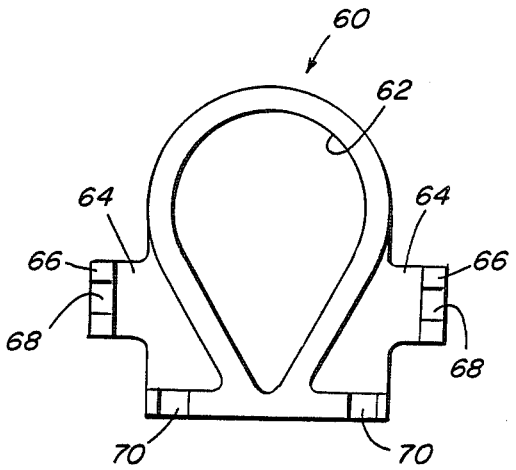
FIG. 8 is a top view of one of two guide blocks of the mounting mechanism.
Figure 10:
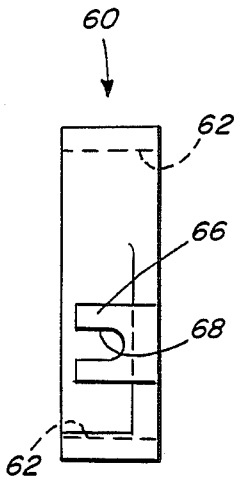
FIG. 10 is a left side view of the guide block.
Figure 9:
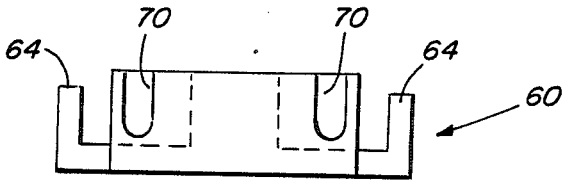
FIG. 9 is a rear elevation of the guide block.

The guide blocks 60, of which there are two, are seen in FIGS. 8 through 10. They are made of a durable, molded plastic having a low coefficient of friction to permit the tube 2 to slide within them. They are hollow and each has a substantially tear-drop interior 62 corresponding to the teardrop shape of the guide tube. Bosses 64 extend from each side of the guide blocks and include ears 66 defining a slot 68 which accommodate bolts to secure the guide blocks within the housing 28. Similar elongated slots 70 are formed normal to the slots 68 to accommodate additional bolts for securing the guide blocks within the housing 28.

Figure 11:
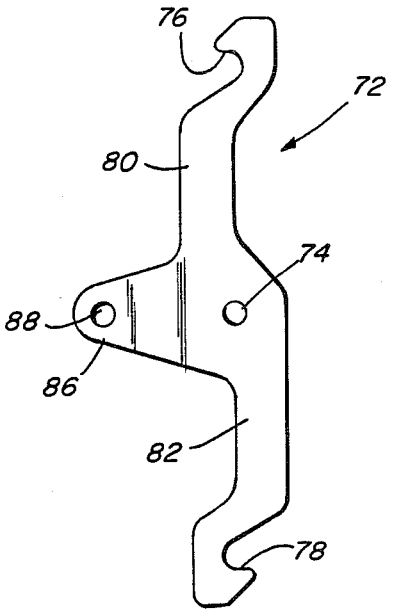
FIG. 11 is a side elevation of a latch bar for the mounting mechanism.
Figure 12:
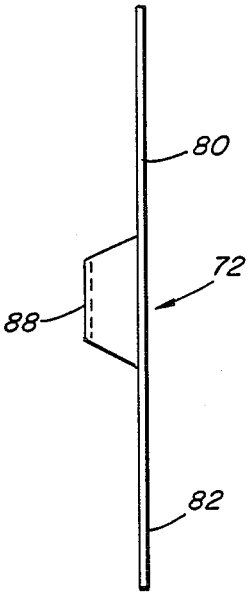
FIG. 12 is a right side view of the latch bar.
Figure 13:
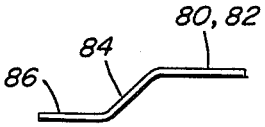
FIG. 13 is a top view of the latch bar.

Referring next to FIGS. 11 through 13, the latch bar 72 will now be described. The purpose of the latch bar is to selectively latch the mounting tube 2 and the marine instrument S in an upper inoperative position and selectively in a lower operative position. The bar may be said to be essentially reversed S-shaped in configuration and pivots about a pin which passes through a hole 74 in the center of the bar. It includes an upper hook latching member 76 and a lower hook latching member 78 at the end of arms 80 and 82 respectively. Offset portion 84 connects with an ear 86 through which there is a hole 88 to which the lanyard 10 may be attached.

The above-described components of the marine instrument mounting mechanism are assembled in the following manner. The instrument, herein illustrated as a sensor S in the form of a searchlight sonar, is adjustably secured to the bottom of the mounting tube 2 as shown in FIGS. 1 and 2 with its top 90 substantially parallel to the bottom 92 of the boat B. The guide blocks 60 are mounted within the housing 28, being spaced apart, one above the other, and held therein by bolts 94 as shown in FIGS. 14 and 16, the bolts passing through the holes 34 in the housing and the slots 68 and 70 in the guide blocks.

Figure 16:
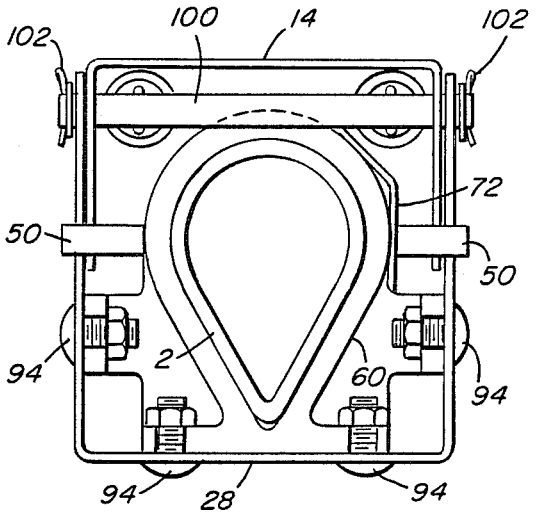
FIG. 16 is a top view of the assembled mounting mechanism.

The mounting tube 2 is inserted into the guide blocks as shown in FIG. 16. Being teardrop shaped not only reduces water resistance but also prevents rotation in the guide blocks.

The latch bar 72 is pivotally mounted in the housing 28 on a stud 96 (FIG. 15) which passes through the hole 74. It is biased in a counter-clockwise direction by a spring 98 (FIG. 14). The lanyard 10, shown in FIGS. 1 and 2, is attached to the latch bar through the hole 88.

Figure 14:
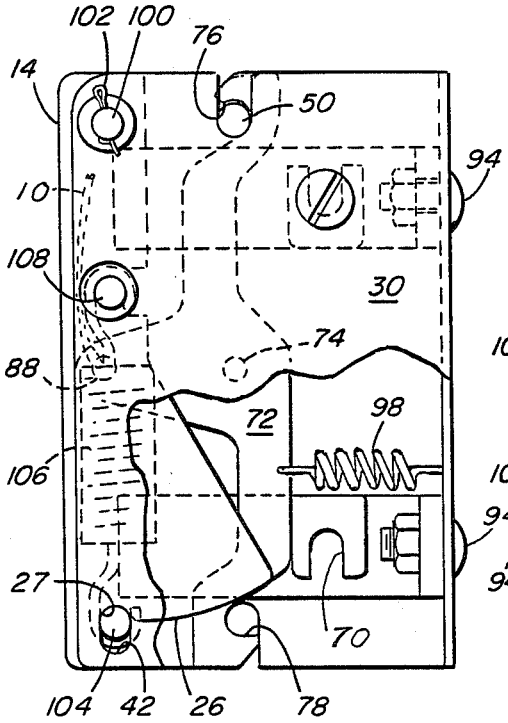
FIG. 14 is a side view of the assembled mounting mechanism.
Figure 15:
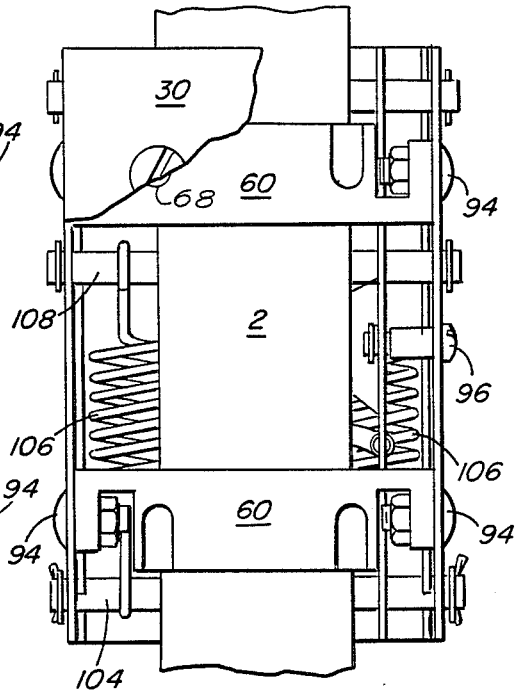
FIG. 15 is a rear view of the assembled mounting mechanism.

As seen in FIG. 14 the latch 76 of the bar 72 is engaged with the upper pin 50, a pair of which project from the tube 2. In this position, the instrument S is latched in the FIG. 2 or operative position. To move the instrument to the FIG. 1 or inoperative position, the lanyard 10 is pulled causing the latch bar 72 to pivot in a clockwise direction thereby releasing the hook or latch 76 from the pin 50. This permits the tube 2 and sensor S to be pulled upwardly through the guide blocks by the lanyard 8. The same motion of the lanyard 10 releases the latch 78 at the bottom of the housing from the pin 52 if it were engaged. Pin 52 would be engaged if the sensor were the tube 2 and sensor S in the FIG. 1 or upper position thereby allowing the sensor S to be lowered to the FIG. 2 position by the lanyard 8.

The housing 28 and hence the tube 2 and sensor S are pivotally mounted on the base 14 by a pin 100 which passes through the holes 38 in the housing 28 and the holes 22 in the base 14. Prior to assembly, the base 14 is secured to the transom T of the boat by screws or bolts passing through the elongated slots 18 in the plate 16 (FIG. 3) which allows slight heightwise adjustment of the base relative to the transom.

The pin 100 is readily removed from the base 14 and the housing 28 by removing cotter pins 102 or other equivalent temporary holding means passing through the pin as shown in FIGS. 14 and 16. This permits the housing 28 plus the mounting tube 2 and the sensor S to be completely removed from the boat, leaving only the mounting base 14 secured to the boat when not in use.

Figure 2:
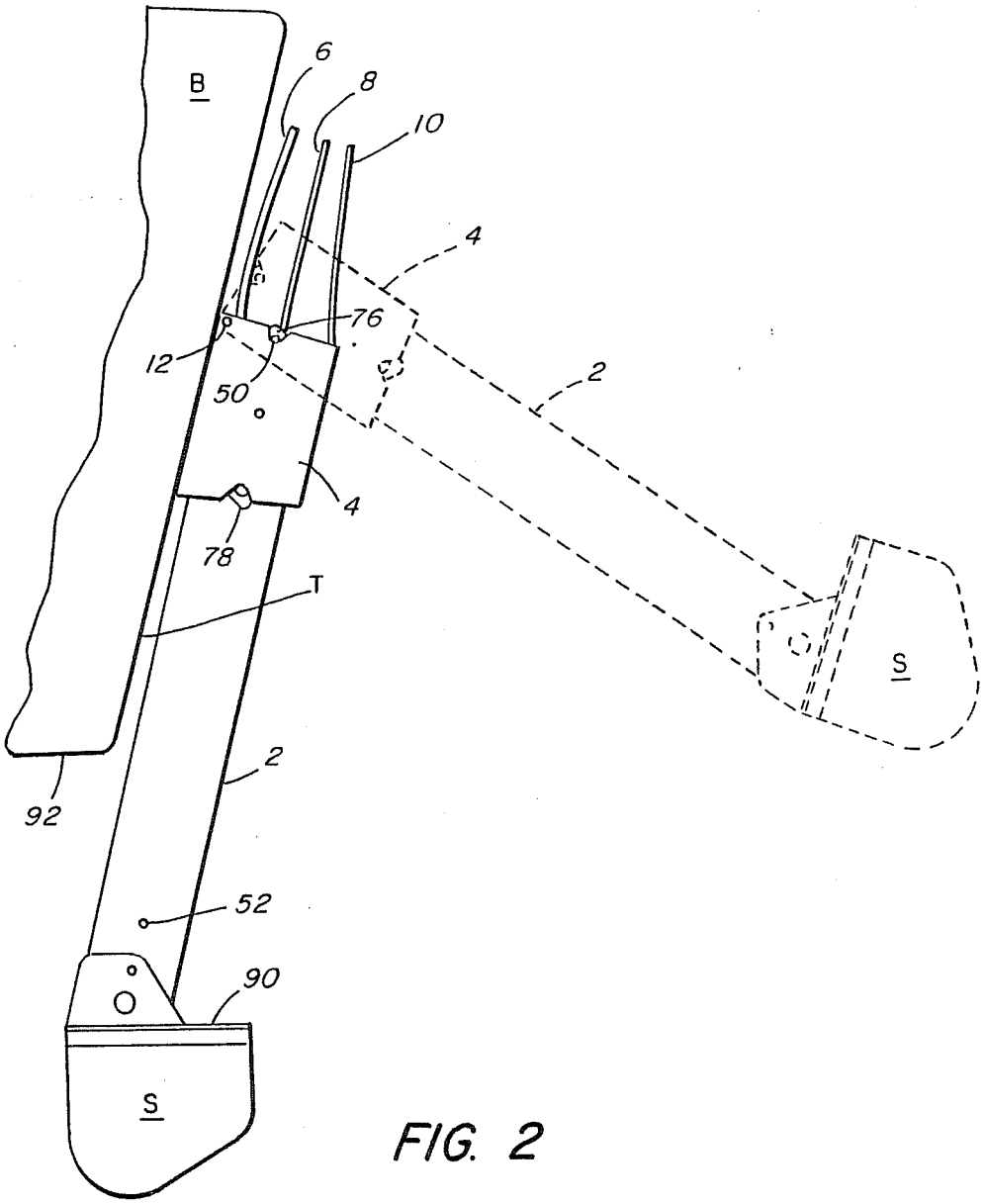
FIG. 2 is a view similar to FIG. 1 with the instrument shown in lowered, operative position with a dotted line showing of the mechanism pivoted upwardly to an inoperative position.

The housing 28, including the mounting tube 2 and the instrument S, are normally free to pivot about the pin 100 from the solid to the dotted line position show in FIG. 2. The means for latching the housing in the operative position will now be described. A movable pin 104 passes through the elongated slots 42 at the bottom of the housing 28. A pair of tension springs 106 connect the pin 104 to a second pin 108 which is accommodated within the slots 42 in the base 14. The tension springs normally urge the pin 104 toward the top of the slot 42. When the mechanism is in the solid line position of FIG. 2, i.e., the operative position, the pin 104 is held at the top of the groove 27 formed in the flange 20 of the mounting base 14. If the tube 2 or the sensor S should strike a submerge object, or if the boat were to exceed a predetermined speed with the sensor lowered, the pin 104 will come out of the slot 27 and ride on the cam surface 26 formed on the flange 20 of the mounting base 14. The housing will pivot upwardly about the pin 100 to prevent the sensor S or the tube 2 from being damaged. The force of the springs 22 are selected to permit the latching mechanism to release under a predetermined force applied to -the tube 2 or the sensor S or the force of the water against the tube and instrument if the boat should exceed a predetermined speed with the instrument in the operative position.

If the boat proceeds at a speed above the slow speed at which the sensor S would be employed, the sensor S and tube 2 remain in unlatched position on dotted line portion of FIG. 2. However, should it be desired to relatch the mechanism, it can be done automatically be reversing the direction of the boat. It is not normally an easy task to reach over the transom and relatch the sensor by hand. Upon reversal, the spring biased pin 104 in the housing 28 will engage and ride upon the gradually increasing angle of the caming surface 26 on the mounting base 14. This offers a degree of resistance to relatching, the resistance being determined not only by the force of the springs 106 but by the shape of the cam surface 26. Only a slight amount of reverse direction of force is necessary to cause the latching pin 104 to reengage within the slot 28 whereupon a fish scanning operation may be recommenced, or if desired, the latch bar may be rotated to permit the tube and instrument to be raised through the guide blocks into the inoperative position should it be desired to proceed at a higher speed.

I claim:

1. An adjustable marine instrument mounting mechanism comprising:

a. a tube having means for mounting an instrument at one end, b. guide blocks through which the tube slides, c. a housing which mounts the guide blocks, d. a base which is attachable to a boat with means for pivotably mounting the guide block housing, and e. means for releasably latching the housing to the base in an operative, non-pivoting position, f. the housing latching means being releasable by a predetermined force to permit the instrument to pivot away from the boat to prevent damage to the instrument in the event it strikes a foreign object or if the boat exceeds a predetermined speed, and g. the means for releasably latching the housing to the base including a force loaded latching bar engageable with a cam on the base, the cam having a surface to produce resistance to the housing becoming engaged with the base to permit the housing and the mounted instrument mechanism to gradually latch to the base when the boat moves in reverse.

2. An adjustable marine instrument mounting mechanism according to claim 1 wherein the mounting tube has a cross-sectional shape to minimize its resistance to the flow of water.

3. An adjustable marine instrument mounting mechanism according to claim 1 wherein the guide blocks are spaced from each other and are firmly secured to the housing.

4. An adjustable marine instrument mounting mechanism comprising:

a. a tube having means for mounting an instrument at one end, b. guide blocks through which the tube slides, c. a housing which mounts the guide blocks, d. a base which is attachable to a boat with means for pivotably mounting the guide block housing, and e. means for releasably latching the housing to the base in an operative position, f. the housing latching means including a force loaded latching bar engagable with a cam having a surface to produce resistance to the housing becoming engaged with the base to permit the housing to be gradually latched to the base when the boat moves in reverse.

5. An adjustable marine instrument mounting mechanism according to claim 4 wherein the mounting tube has a cross-sectional shape to minimize its resistance to the flow of water.

6. An adjustable marine instrument mounting mechanism according to claim 4 wherein the guide blocks are spaced from each other and are firmly secured to the housing.

7. An adjustable marine instrument mounting mechanism comprising:

a. a tube having means for mounting a instrument at one end.

b. guide blocks through which the tube slides, c. a housing which mounts the guide blocks, d. a base which is attachable to a boat with means for pivotably mounting the guide block housing, and e. means for releasably latching the tube to the housing in an elevated position to locate the instrument in an inoperative position and in a lowered position to locate the instrument in an operative position, and f. the means for latching the tube comprising a double-acting, pivotal latch bar, a pair of pins extending from the mounting tube, each pin being engageable with a separate hook means on the latch bar, and means for manually pivoting the latch bar to release it from engagement with the pin with which it is engaged.

8. An adjustable marine instrument mounting mechanism according to claim 7 wherein the mounting tube has a cross-sectional shape to minimize its resistance to the flow of water.

9. An adjustable marine instrument mounting mechanism according to claim 7 wherein the guide blocks are spaced from each other and are firmly secured to the housing.

10. An adjustable marine instrument mounting mechanism comprising:

a. a tube having means for mounting an instrument at one end, b. guide blocks through which the tube slides, c. a housing which mounts the guide blocks, d. a base which is attachable to a boat with means for pivotably mounting the guide block housing, and e. means for releasably latching the housing to the base in an operative, non-pivoting position, f. the housing latching means being releasable by a predetermined force to permit the instrument to pivot away from the boat to prevent damage to the instrument in the event it strikes a foreign object or if the boat exceeds a predetermined speed, g. the housing latching means including a force loaded latching bar engagable with a cam having a surface to produce resistance to the housing becoming engaged with the base to permit the housing to be gradually latched to the base when the boat moves in reverse.

11. An adjustable marine instrument mounting mechanism comprising:

a. a tube having means for mounting an instrument at one end, b. guide blocks through which the tube slides, c. a housing which mounts the guide blocks, d. a base which is attachable to a boat with means for pivotably mounting the guide block housing, and e. means for releasably latching the housing to the base in an operative, non-pivoting position, f. the housing latching means being releasable by a predetermined force to permit the instrument to pivot away from the boat to prevent damage to the instrument in the event it strikes a foreign object or if the boat exceeds a predetermined speed, g. the housing latching means including a force loaded latching bar engageable with a cam having a surface to produce resistance to the housing becoming engaged with the base to permit the housing to be gradually latched to the base when the boat moves in reverse, and h. means for releasably latching the tube to the housing in an elevated position to locate the instrument in an inoperative position and in a lowered position to locate the instrument in an operative position.

* * * * *